US007845752B2

(12) United States Patent
Ito et al.

(10) Patent No.: US 7,845,752 B2
(45) Date of Patent: Dec. 7, 2010

(54) LIQUID-DISCHARGE-FAILURE DETECTING APPARATUS AND INKJET RECORDING APPARATUS

(75) Inventors: Kazumasa Ito, Tajimi (JP); Hirotaka Hayashi, Nagoya (JP)

(73) Assignee: Ricoh Elemex Corporation, Nagoya-shi (JP)

( * ) Notice: Subject to any disclaimer, the term of this patent is extended or adjusted under 35 U.S.C. 154(b) by 212 days.

(21) Appl. No.: 12/265,355

(22) Filed: Nov. 5, 2008

(65) Prior Publication Data

US 2009/0115812 A1 May 7, 2009

(30) Foreign Application Priority Data

Nov. 6, 2007 (JP) ..... 2007-288011

(51) Int. Cl.
*B41J 29/393* (2006.01)

(52) U.S. Cl. ..... 347/19

(58) Field of Classification Search ..... 347/19
See application file for complete search history.

(56) References Cited

U.S. PATENT DOCUMENTS 6,897,466 B2 * 5/2005 Teramae et al. ..... 347/19

FOREIGN PATENT DOCUMENTS

| | | | |
|---|---|---|---|
| EP | 1 364 796 | A1 | 11/2003 |
| EP | 1 498 274 | A1 | 1/2005 |
| JP | 2006-007447 | A1 | 1/2006 |

OTHER PUBLICATIONS

U.S. Appl. No. 12/277,093, filed Nov. 24, 2008, Hayashi et al.

* cited by examiner

*Primary Examiner*—Julian D Huffman
(74) *Attorney, Agent, or Firm*—Foley & Lardner LLP

(57) ABSTRACT

A liquid-discharge-failure detecting apparatus includes a light-emitting unit, a light-receiving unit, and a light-trapping unit. The light-emitting unit emits a detection beam. The light-receiving unit is located at a position offset from an optical axis of the detection beam, and receives a scattered light generated by scattering of the detection beam by a droplet of ink (liquid). The light-trapping unit traps a detection beam that travels straight without striking the droplet so that the detection beam does not enter the light-receiving unit as a stray light.

8 Claims, 1 Drawing Sheet

LIQUID-DISCHARGE-FAILURE DETECTING APPARATUS AND INKJET RECORDING APPARATUS

CROSS-REFERENCE TO RELATED APPLICATIONS

The present application claims priority to and incorporates by reference the entire contents of Japanese priority document 2007-288011 filed in Japan on Nov. 6, 2007.

BACKGROUND OF THE INVENTION

1. Field of the Invention

The present invention relates to a technology for detecting a liquid discharge failure in an inkjet recording apparatus.

2. Description of the Related Art

A typical inkjet printer includes a liquid-discharge-failure detecting device for detecting an ink discharge failure. For this purpose, the inkjet printer includes a light-emitting unit and a light-receiving unit. The light-emitting unit emits a detection beam toward an ink droplet. The light-receiving unit is located at a position offset from an optical axis of the detection beam to receive a scattered light generated by scattering of the detection beam by the ink droplet. The liquid-discharge-failure detecting device optically detects an ink discharge failure by using data pertaining to the scattered light received by the light-receiving unit.

Such an inkjet printer is disadvantageous in that a detection beam that strays inside the inkjet printer as a stray light can enter the light-receiving unit after being reflected from a head nozzle surface of an inkjet head or the like, which may result in faulty detection. Various techniques have been proposed for avoiding such faulty detection. An example of such a technique is disclosed in Japanese Patent Application Laid-open No. 2006-7447. According to this technique, an aperture member having an aperture is provided immediate upstream of a light-receiving unit along an optical path so that unnecessary detection beam reflected from a head nozzle surface of an inkjet head or the like is blocked by the aperture member and only necessary the scattered light passes through the aperture.

Moreover, occurrence of optical diffraction can lead to incorrect detection of an ink discharge failure. To this end, Japanese Patent Application Laid-open No. 2006-7447 discloses increasing the amounts of liquid discharged through nozzles at positions near the light-receiving unit than those discharged through the other nozzles.

However, it is difficult to employ this technique for a wide inkjet head. This technique also disadvantageously requires complicated processing to perform liquid discharge control, decreases durability of a specific nozzle(s), and increases an amount of ink required for detection.

SUMMARY OF THE INVENTION

It is an object of the present invention to at least partially solve the problems in the conventional technology.

According to an aspect of the present invention, there is provided a liquid-discharge-failure detecting apparatus that detects a liquid discharge failure of a droplet of discharged liquid. The liquid-discharge-failure detecting apparatus includes a light-emitting unit that emits a detection beam toward the droplet; a light-receiving unit that receives a scattered light generated by scattering of the detection beam by the droplet, wherein the light-receiving unit is located at a position offset from an optical axis of the detection beam; a failure detecting unit that detects a liquid discharge failure by using data pertaining to the scattered light received by the light-receiving unit; and a light-trapping unit that traps a detection beam that does not strike the droplet and travels straight so that the detection beam does not enter the light-receiving unit as a stray light.

According to another aspect of the present invention, there is provided an inkjet recording apparatus comprising a liquid-discharge-failure detecting apparatus that detects a liquid discharge failure of a droplet of discharged liquid. The liquid-discharge-failure detecting apparatus including a light-emitting unit that emits a detection beam toward the droplet; a light-receiving unit that receives a scattered light generated by scattering of the detection beam by the droplet, wherein the light-receiving unit is located at a position offset from an optical axis of the detection beam; a failure detecting unit that detects a liquid discharge failure by using data pertaining to the scattered light received by the light-receiving unit; and a light-trapping unit that traps a detection beam that does not strike the droplet and travels straight so that the detection beam does not enter the light-receiving unit as a stray light.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are described in detail below with reference to the accompanying drawings.

Figure 1:
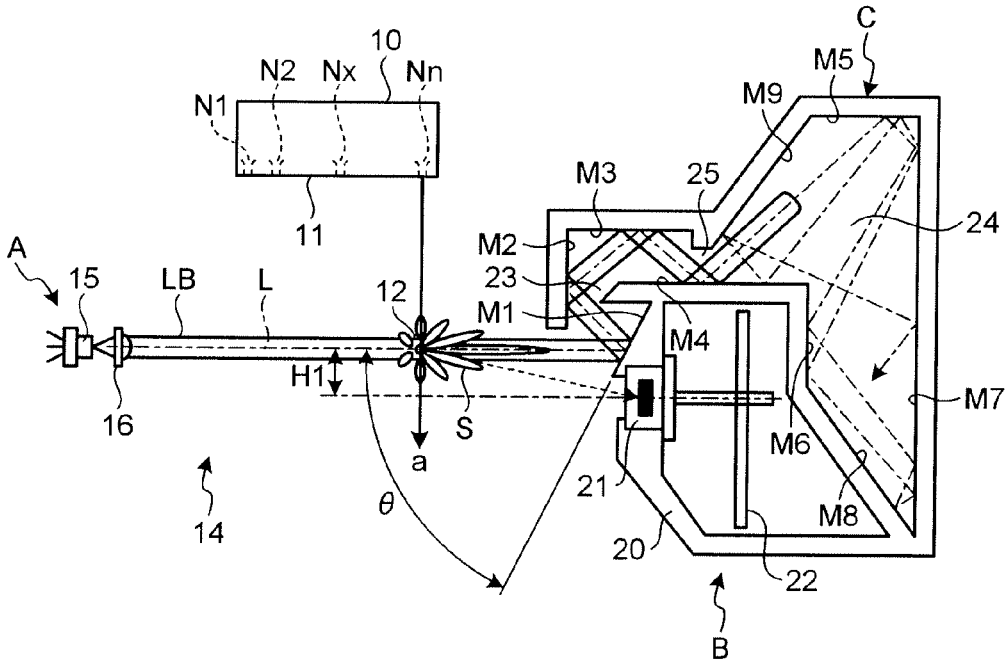
FIG. 1 is a schematic diagram of a relevant portion of an inkjet printer including a liquid-discharge-failure detecting apparatus according to a first embodiment of the present invention.

FIG. 1 is a schematic diagram of a relevant portion of an inkjet printer, which includes a liquid-droplet discharging unit. The inkjet printer is an example of an inkjet recording apparatus. The inkjet printer includes a liquid-discharge-failure detecting apparatus 14 according to a first embodiment of the present invention.

The inkjet printer includes an inkjet head 10. A bottom surface of the inkjet head 10 is a head nozzle surface 11 as a liquid-droplet-discharge surface. On the head nozzle surface 11, a plurality of nozzles N1, N2, . . . Nx, . . . , and Nn are arranged on a line (hereinafter, "nozzle line") at regular intervals with each other. Ink droplets are discharged from the nozzles N1 to Nn. In the example shown in FIG. 1, an ink droplet 12 is discharged from the nozzle Nx in a direction indicated by an arrow a.

The liquid-discharge-failure detecting apparatus 14 is arranged below the inkjet head 10. The liquid-discharge-failure detecting apparatus 14 includes a light-emitting unit A, a light-receiving unit B, a failure detecting unit (not shown), and a light-trapping unit C. The light-emitting unit A emits a detection beam LB. The light-receiving unit B is located at a position offset from an optical axis L of the detection beam LB, and receives a scattered light S generated by scattering of the detection beam LB by the ink droplet 12. The failure detecting unit detects a liquid discharge failure by using data pertaining the scattered light S received by the light-receiving unit B. The light-trapping unit C traps, if the detection beam LB does not strike the ink droplet 12 and travels straight, the detection beam LB so that the detection beam LB cannot enter the light-receiving unit B as a stray light.

The light-emitting unit A includes a light-emitting element 15, a collimating lens 16, and a light-emission control circuit board (not shown). The light-emitting element 15 can be a laser diode (LD) or a light-emitting diode (LED). The light-emitting element 15 emits light, and the collimating lens 16 collimates the light into the detection beam LB, which is parallel to the optical axis L and less easily diffuse. The light-emission control circuit board includes a control unit (not shown) that controls light emission of the light-emitting element 15.

The light-receiving unit B includes a light-receiving element 21 in a casing 20 at a position offset by an offset distance HI from the optical axis L. The light-receiving element 21 can be a photodiode (PD). The casing 20 houses a light-receiving circuit board 22 that includes a control unit (not shown) that determines whether a liquid discharge failure such as a misdischarge and an oblique discharge has occurred based on data pertaining to the scattered light S received by the light-receiving element 21.

Both the light-receiving unit B and the light-trapping unit C are housed in the casing 20 to thus be structurally integrated. The casing 20 has a trapping chamber 24. The trapping chamber 24 has a first aperture 23 and a second aperture 25, each of which is a small opening. The trapping chamber 24 includes a first reflection surface MI at a position upstream of the first aperture 23 along an optical path of the detection beam LB. The first reflection surface M1 is slanted by an angle of θ relative to the optical axis L and is a total reflection surface that guides the detection beam LB to the first aperture 23. The second aperture 25 is located downstream of the first aperture 23. Second to ninth reflection surfaces M2 to M9 are provided on internal surfaces of the trapping chamber 24 downstream of the first aperture 23 along the optical path. The second to ninth reflection surfaces M2 to M9 are diffuse reflection surfaces, on which the detection beam LB is diffusively reflected and attenuated.

The liquid-discharge-failure detecting apparatus 14 is positioned such that the optical axis L is parallel to the nozzle line. In other words, the liquid-discharge-failure detecting apparatus 14 is positioned such that the detection beam LB strikes the ink droplet 12 at about a right angle with respect to the direction a in which the ink droplet 12 is discharged from the head nozzle surface 11.

When the ink droplet 12 is discharged from the nozzle Nx and the detection beam LB strikes the discharged ink droplet 12, the detection beam LB generates the scattered light S. The light-receiving element 21 receives the scattered light S at a receiving surface of the light-receiving element 21. More particularly, the receiving surface receives a forward scattered light out of the scattered light S. The liquid-discharge-failure detecting apparatus 14 obtains data pertaining to the scattered light S from an optical output of the light-receiving element 21, and optically detects various liquid discharge failures, such as a misdischarge and an oblique discharge, based on the data.

When the detection beam LB strikes the ink droplet 12, a portion of the detection beam LB falls on the first reflection surface M1 is totally reflected from the first reflection surface M1 to be guided into the first aperture 23. The detection beam LB is then reflected from the second reflection surface M2 to be guided to enter the trapping chamber 24. The detection beam LB is further reflected from the third reflection surface M3 and from the fourth reflection surface M4 in this order to thus be guided through the second aperture 25 to a downstream portion of the trapping chamber 24. The detection beam LB is further reflected from, for example, the fifth to ninth reflection surfaces M5 to M9 in this order, thereby being gradually attenuated.

In short, with this configuration, the detection beam LB that travels straight is totally reflected from the first reflection surface M1 and guided inside the trapping chamber 24 through the first aperture 23. Hence, the detection beam LB is trapped in the trapping chamber 24 without fail. Furthermore, the detection beam LB is diffusively reflected from the reflection surfaces M2 to M9 in the trapping chamber 24, thereby being attenuated. Accordingly, the detection beam LB is prevented from entering the light-receiving unit B located outside the trapping chamber 24. Hence, the detection beam LB emitted from the light-emitting unit A is completely prevented from becoming a stray light that can cause faulty detection.

The casing 20 can be made from a resin. When the casing 20 is formed from a resin, the first reflection surface M1 is preferably formed as a mirror reflection surface so that the surface M1 has a high reflectivity that causes total reflection. To further increase the reflectivity, an optical mirror can be used. More specifically, for example, a mirror layer of aluminum can be formed on the first reflection surface M1 by deposition. Meanwhile, satin-like finishing can be applied onto the reflection surfaces M2 to M9 of the trapping chamber 24 for more diffusive reflection. Alternatively, a light-absorption sheet or the like can be affixed onto the reflection surfaces M2 to M9.

The angle θ; i.e., the angle between the first reflection surface M1 and the optical axis L, can be adjusted depending on how much down-sizing of the light-trapping unit C is to be achieved, how many times the detection beam LB is to be reflected, and the like. Because the first reflection surface M1 is a total reflection surface, when the angle θ is set appropriately, the detection beam LB is prevented from traveling toward the light-emitting element 15 after being reflected from the surface M1. Hence, the detection beam LB is prevented from becoming a stray light.

In the example shown in FIG. 1, the detection beam LB reflected from the first reflection surface M1 is further reflected from the second reflection surface M2 to thus be guided to reach a downstream portion of the trapping chamber 24 through the second aperture 25. The detection beam LB is trapped inside the trapping chamber 24 and it undergoes multiple reflections inside the trapping chamber 24. As a result, the light intensity of the detection beam LB is attenuated. Nearer the second aperture 25 is to the first aperture 23, more the difficult is for the detection beam LB to return toward the first aperture 23. Consequently, the detection beam LB undergoes multiple reflections in the downstream portion of the trapping chamber 24 whereby the detection beam LB is trapped more reliably. Put another way, provision of the second aperture 25 in addition to the first aperture 23 improves effectiveness in light trapping.

In the example shown in FIG. 1, because the light-receiving unit B and the light-trapping unit C are structurally integrated, the structure of the liquid-discharge-failure detecting apparatus 14 is simplified, and the offset distance H1, which is the distance between the optical axis L and the detection beam LB, can be reduced. When the offset distance H1 is small, the liquid-discharge-failure detecting apparatus 14 can be down-sized; also, the light-receiving element 21 can receive a greater amount of higher-intensity scattered light S.

Figure 2:
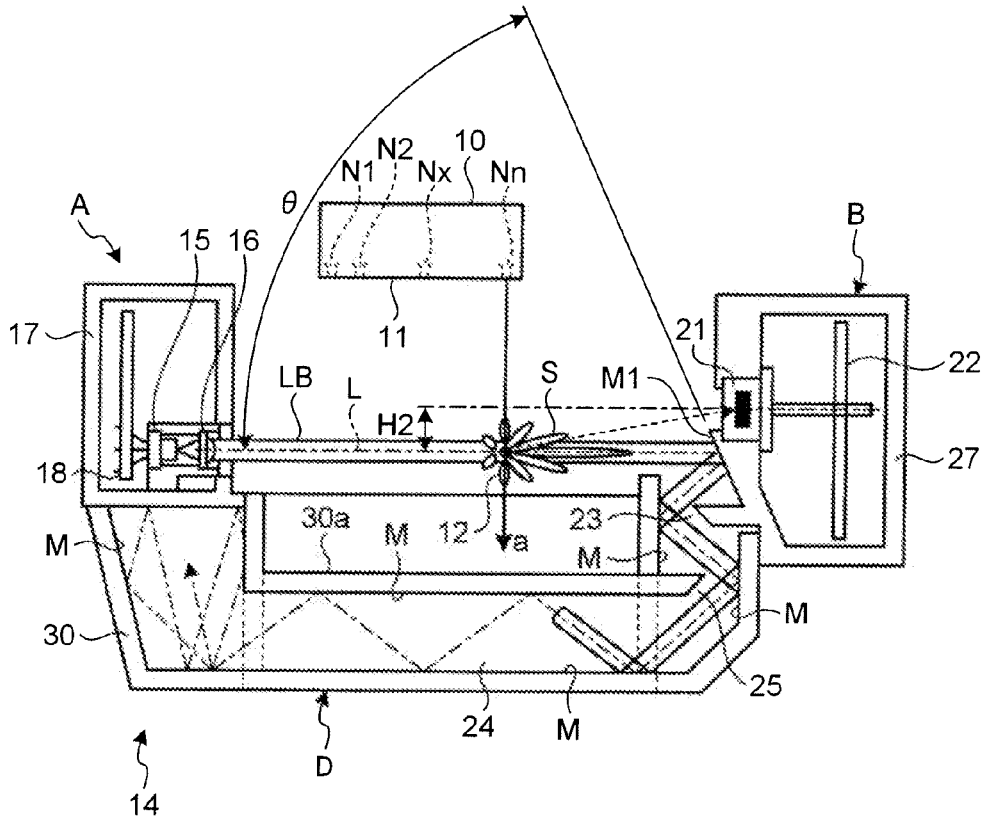
FIG. 2 is a schematic diagram of a relevant portion of an inkjet printer including a liquid-discharge-failure detecting apparatus according to a second embodiment of the present invention.

FIG. 2 is a schematic diagram of a relevant portion of an inkjet printer including a liquid-discharge-failure detecting apparatus according to a second embodiment of the present invention. The same components as those of the first embodiment are denoted by the same reference numerals and symbols, and repeated descriptions thereof are omitted.

The light-emitting unit A of the liquid-discharge-failure detecting apparatus 14 according to the second embodiment includes, in a first casing 17, the light-emitting element 15, the collimating lens 16, and a light-emission control circuit board 18. The light-emitting element 15 can be an LD or an LED. The light-emitting element 15 emits light, and the collimating lens 16 collimates the light into the detection beam LB, which is parallel to the optical axis L and less easily diffuse. The light-emission control circuit board 18 controls light emission of the light-emitting element 15.

The light-receiving unit B includes the light-receiving element 21 in a second casing 27 at a position offset by an offset distance H2 from the optical axis L. The light-receiving element 21 can be an LD. The second casing 27 houses the light-receiving circuit board 22 that includes a control unit (not shown) that determines whether a liquid discharge failure such as a misdischarge and an oblique discharge has occurred based on data about the scattered light S received by the light-receiving element 21.

A third casing 30 is provided between the light-emitting unit A and the light-receiving unit B and joined with the first casing 17 and with the second casing 27 to integrally form a light-trapping unit D. In the same manner as in the light-trapping unit C in the first embodiment, the light-trapping unit D includes the trapping chamber 24 and includes the first aperture 23.

The first reflection surface M1, which is the surface slanted by the angle θ relative to the optical axis L, is provided on the third casing 30 at a position upstream of the first aperture 23 along the optical path. Light is totally reflected from the first reflection surface M1 to be guided into the first aperture 23. The second aperture 25 is provided in the trapping chamber 24 at a position downstream of the first aperture 23. A plurality of reflection surfaces M are provided on the internal surface of the third casing 30 at positions downstream of the first aperture 23 along the optical path. Each of the reflection surfaces M diffusively reflects light thereon, thereby attenuating the light.

An ink receptacle 30a is provided on the third casing 30 to receive ink droplets discharged from the nozzles N1 to Nn. The ink receptacle 30*a* and the light-trapping unit D are structurally integrated so that the ink receptacle 30*a* and the light-trapping unit D can be treated as a unit. This configuration facilitates handling of the liquid-discharge-failure detecting apparatus 14 in the inkjet printer.

The ink receptacle 30*a* defines a space into which the optical path for the detection beam LB trapped in the light-trapping unit D can extend. By virtue of this space, the optical path of this structure is longer than that of the first embodiment. Accordingly, the detection beam LB trapped in the light-trapping unit D can be guided to the optical path defined by the ink receptacle 30*a* and attenuated without returning to the outside of the trapping chamber 24. That is, the detection beam LB is prevented from traveling out of the light-trapping unit D and entering the light-receiving unit B. Thus, with this structure, the detection beam LB emitted from the light-emitting unit A is prevented without fail from becoming a stray light in the inkjet printer, and faulty detection is prevented more reliably.

In the example shown in FIG. 2, all of the light-emitting unit A, the light-receiving unit B, and the light-trapping unit D are integrated together. Alternatively, only two of those units can be integrated together. For example, the light-emitting unit A and the light-receiving unit B, which require accurate positioning with respect to each other, can be integrated so that accuracy in positioning of the optical system is increased.

In the embodiments, the light-trapping unit C or D is constructed such that the detection beam LB that does travels straight without striking the ink droplet 12 is guided through the first aperture 23 into the trapping chamber 24 formed by the casing 20 or the third casing 30 and attenuated in the trapping chamber 24 so that the detection beam LB cannot enter the light-receiving unit B as a stray light. Alternatively, the light-trapping unit can be formed by providing one or more filters in the casing or providing the same in place of the casing. This alternative structure also causes the detection beam LB emitted from the light-emitting unit A to be attenuated through the filters and prevents the detection beam LB from becoming a stray light and causing faulty detection. With this alternative structure, the casing can be further down-sized or omitted, making the configuration of the liquid-discharge-failure detecting apparatus 14 simple.

According to an aspect of the present invention, a light-trapping unit traps a detection beam that travels straight without striking a droplet of liquid with a simple structure. Therefore, even when a scattered-light detection method that can be applied to a wide inkjet head is used, faulty detection caused by a detection beam that enters the light-receiving unit after being reflected from a head nozzle surface or the like of an inkjet nozzle can be avoided. Moreover, adverse effects on durability of a specific nozzle(s) and on an amount of ink required for detection can be avoided.

Moreover, the detection beam that travels straight without striking an ink droplet is reflected from the reflection surface, which is located upstream in an optical path of the detection beam, and guided through an aperture into a trapping chamber. Accordingly, the detection beam is trapped within the trapping chamber without fail. Furthermore, because the reflection surfaces of the trapping chamber are diffuse reflection surfaces, the trapped beam is attenuated while being reflected from the reflection surfaces. Hence, the detection beam is prevented from entering the light-receiving unit outside the trapping chamber.

Furthermore, because the light-receiving unit and the light-trapping unit are structurally integrated, the liquid-discharge-failure detecting apparatus can be down-sized. Treating these units as one unit also facilitates handling of the apparatus.

Moreover, because an ink receptacle and a light-trapping unit are structurally integrated, the liquid-discharge-failure detecting apparatus can be down-sized. Treating the ink receptacle and the light-trapping unit as a unit also facilitates handling of the liquid-discharge-failure detecting apparatus in the inkjet recording apparatus.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A liquid-discharge-failure detecting apparatus that detects a liquid discharge failure of a droplet of discharged liquid, the liquid-discharge-failure detecting apparatus comprising:

a light-emitting unit that emits a detection beam toward the droplet;

a light-receiving unit that receives a scattered light generated by scattering of the detection beam by the droplet, wherein the light-receiving unit is located at a position offset from an optical axis of the detection beam;

a failure detecting unit that detects a liquid discharge failure by using data pertaining to the scattered light received by the light-receiving unit; and a light-trapping unit that traps a detection beam that does not strike the droplet and travels straight so that the detection beam does not enter the light-receiving unit as a stray light.

2. The liquid-discharge-failure detecting apparatus according to claim 1, wherein the light-trapping unit includes a surface that is slanted with respect to the optical axis and that reflects the detection beam to prevent the detection beam from entering the light-receiving unit.

3. The liquid-discharge-failure detecting apparatus according to claim 1, wherein the light-trapping unit includes a trapping chamber having an aperture through which the detection beam enters the trapping chamber.

4. The liquid-discharge-failure detecting apparatus according to claim 3, wherein the light-trapping unit includes a first reflection surface and a second reflection surface, the first reflection surface is a total reflection surface that reflects light having entered the light-trapping unit through the aperture, and the second reflection surface is a diffuse reflection surface that reflects light reflected from the first reflection surface.

5. The liquid-discharge-failure detecting apparatus according to claim 1, wherein the light-receiving unit and the light-trapping unit are structurally integrated.

6. An inkjet recording apparatus comprising a liquid-discharge-failure detecting apparatus that detects a liquid discharge failure of a droplet of discharged liquid, the liquid-discharge-failure detecting apparatus including a light-emitting unit that emits a detection beam toward the droplet;

a light-receiving unit that receives a scattered light generated by scattering of the detection beam by the droplet, wherein the light-receiving unit is located at a position offset from an optical axis of the detection beam;

a failure detecting unit that detects a liquid discharge failure by using data pertaining to the scattered light received by the light-receiving unit; and a light-trapping unit that traps a detection beam that does not strike the droplet and travels straight so that the detection beam does not enter the light-receiving unit as a stray light.

7. The inkjet recording apparatus according to claim 6, further comprising an ink receptacle that receives a droplet of ink corresponding to the droplet, wherein the ink receptacle and the light-trapping unit are structurally integrated.

8. The inkjet recording apparatus according to claim 7, wherein the ink receptacle defines a space into which the optical path of the detection beam trapped in the light-trapping unit can extend.

* * * * *